US005778297A

United States Patent [19]

Reichl et al.

[11] Patent Number: 5,778,297

[45] Date of Patent: Jul. 7, 1998

[54] MULTI-FUNCTIONAL PRINTER DEVICE FOR PRINTING TAPE-SHAPED RECORDING MEDIA

[75] Inventors: Helmut Reichl, Füstenfeldbruck; Hans Manzer, Seefeld; Manfred Viechter, Walpertskirchen, all of Germany

[73] Assignee: Siemens Nixdorf Informationssysteme Aktiengesellschaft, Paderborn, Germany

[21] Appl. No.: 624,462

[22] PCT Filed: May 8, 1995

[86] PCT No.: PCT/DE95/00604

§ 371 Date: May 20, 1996

§ 102(e) Date: May 20, 1996

[87] PCT Pub. No.: WO96/02871

PCT Pub. Date: Feb. 1, 1996

[30] Foreign Application Priority Data

Jul. 15, 1994 [DE] Germany ..... 44 25 074.6

[51] Int. Cl.[6] ..... G03G 21/00

[52] U.S. Cl. ..... 399/384; 399/401

[58] Field of Search ..... 399/384, 385, 399/386, 387, 375, 401

[56] References Cited

U.S. PATENT DOCUMENTS

| | | | |
|---|---|---|---|
| 5,467,179 | 11/1995 | Boeck et al. | 355/309 |
| 5,526,107 | 6/1996 | Bronstein | 355/319 |
| 5,546,178 | 8/1996 | Manzer et al. | 355/319 |
| 5,568,245 | 10/1996 | Ferber et al. | 355/309 |

*Primary Examiner*—R. L. Moses

[57] ABSTRACT

An electrographic printer device is designed for printing tape-shaped recording media (10) with different tape widths in different operating modes such as single-color and multi-color simplex printing, single-color and multi-color duplex printing and for simultaneous printing of two recording medium webs in parallel operation. It comprises a module-like device structure with a printer module having a means for generating toner images arranged therein. A single fixing station (18) is arranged above this means. Via a deflection means (28), the recording medium (10) is supplied in single-color or multi-color duplex mode to a return channel (38) that contains a turn-over station (30).

15 Claims, 8 Drawing Sheets

MULTI-FUNCTIONAL PRINTER DEVICE FOR PRINTING TAPE-SHAPED RECORDING MEDIA

BACKGROUND OF THE INVENTION

The invention is directed to an electrographic printer device for printing tape-shaped recording media of different tape widths with a possible return of the recording medium from the fixing station to the transfer printing station for producing duplex and color printing.

FIELD OF THE INVENTION

A high economic benefit to the customer and a broad spectrum of flexibility are expected from modern electrographic printer systems to a greatly increasing extent. Both the effective utilization of printing materials as well as the flexible fashioning of the print information play a large part therein.

Endlessly processing (fan-fold) electrographic printer systems that print a band-shaped recording medium on one side have prevailed everywhere in the marketplace where a high device availability given high printing volume and a broad spectrum of material to be printed are demanded. These printer systems, however, have the disadvantage that it is not possible to change between single-sided and double-sided printing. For the user, this leads both to an economically unfavorable situation as well as to a contradiction of contemporary demands made of raw materials'utilization. Many customized applications that wherein double-sided printing is compulsory (brochures, books, etc.) can thus not be satisfied, especially since electrographic highperformance printers are especially efficient when they are operated as free of interruption as possible.

For producing multi-color and backside printing with electrographic printer devices processing continuous stock, EP-B1-01 54 695 discloses that two continuous stock printers be operated following one another, whereby the paper printed in the first printer is turned over and is subsequently printed on the second side in the second printer.

The outlay is substantial due to the required, second printer.

The reference IBM Technical Disclosure Bulletin, Vol.22, No.6, November 1979, page 2466, FIG. 2, also discloses an electrophotographic printer device for printing tape-shaped recording media with which it is possible to print the recording medium on both sides. To this end, the recording medium is pulled from a supply stack, supplied to a transfer printing station and provided with toner images on one side. After the fixing, the recording medium is turned over and is resupplied to the transfer printing station. Another fixing in the fixing station ensues after the back side of the recording medium has been printed with toner images.

This old reference fundamentally discloses duplex printing with continuous stock recording media. The proposal, however, never led to a product. Further, the electrographic printer device disclosed therein is only suited for both-sided printing of the recording medium. A change of operating modes is not provided.

The reference Xerox Disclosure Journal, Vol.9, No.3, May 1984, Stanford, Connecticut, USA, pages 2001 through 2003 discloses methods for duplex printing with a tape-shaped recording medium having differently constructed electrophotographic printer devices. In a first duplex printing process, a toner image is first applied on a front side of the recording medium and the recording medium together with the toner image is then turned over and the toner image is simultaneously fixed by a fixing means attached in the region of the turn-over device. After the turn-over event and the fixing of the toner image of the front side, a back-side toner image is applied with the assistance of the transfer printing station, this toner image being then in turn fixed with the assistance of a fixing means to the printer device at the output side.

In a second method for producing duplex printing, a toner image of the front side is first applied with the assistance of the transfer printing station. Subsequently, the recording medium is turned over and the application of the toner image of the back side then ensues. Both toner images are simultaneously fixed via a fixing station of the output side. In a third method for producing simplex printing on a narrow or double-width recording medium, the application of the single toner image ensues with a correspondingly width-matched transfer printing station, whereby the toner image is then fixed via a width-matched fixing station of the output side.

A switching between the individual operating modes, for example duplex and simplex, is not provided in the known apparatus. Separate fixing stations for the front and back side are employed in duplex operation with intermediate fixing, whereby the front side fixing station is arranged in the region of the turn-over means.

Printer devices of the species initially cited, as disclosed in the earlier application PCT/EP94/01493, which does not enjoy priori publication and whose content is a constituent part of the disclosure of the present application, require good accessibility to the paper path, especially in the region of the deflection means, so that one can easily intervene in case of malfunction. Further, a simple change in operating mode must be possible.

The fixing process also has considerable influence on the printing quality. The radiant energy required for the fixing should act on the toner image in targeted fashion. A heating of other components of the printer device and of the paper web that goes beyond this must be avoided.

The high-precision allocation of the individual device components needed for the operation of the printer device continues to require a stable structure of the apparatus.

High-performance printer devices for continuous stock paper are increasingly developing into components of extensive systems wherein the pre-processing and after-processing of the papers, backside and color printing play an increasing role in addition to the actual print production.

SUMMARY OF THE INVENTION

An object of the invention is to offer an electrographic printer device for printing tape-shaped recording media in changing operating modes with one and the same apparatus that is flexibly constructed and that enables an adaptation to the greatest variety of user demands by the user himself in a simple way.

In an electrographic printer of the species initially cited, this object is achieved according to the features of the first patent claim.

Advantageous embodiments of the invention are characterized in the subclaims.

The inventive electrographic printer device comprises a usable width of at least twice the tape width of a narrow recording medium. A deflection means for the narrow recording medium that follows the fixing station is adjustably fashioned, namely dependent on the operating status of the printer device. For repeated printing of a single, narrow recording medium, for example for producing single-color or multi-color duplex printing or for producing multi-color simplex printing, the recording medium is conducted over the transfer printing station to the fixing station and, from the latter, is again conducted to the transfer printing station and to the fixing station via the deflection means. For single-sided printing of a recording medium having a tape width that is wider than that of the narrow recording medium or for printing a plurality of narrow recording media in parallel mode, a guidance of the recording medium ensues only over the transfer printing station to the fixing station.

A high degree of adaptability to a changing system environment derives due to the fashioning of the actual printer device as a printer module that can be coupled to the greatest variety of units. Since the deflection means is arranged outside the actual printer module, it is easily accessible. First, malfunctions in paper running can thus be easily eliminated; second, a simple change in operating modes is possible.

The arrangement of the fixing station above the means that generates the toner images and the course of the return channel under this means reduces the thermal load of the recording medium and of the other units of the printer device, and thus enables a compact structure without additional cooling measures.

The deflection means and the turn-over means are arranged immediately under the paper web emerging essentially horizontally from the fixing station, being likewise essentially horizontally arranged such that the web that has been turned over is resupplied over the shortest path to the printer module for printing the back side.

Without increasing the apparatus-oriented outlay compared to traditional machines, the inventive electrographic printer means enables—with one and the same apparatus—the printing of broad recording media in transverse and longitudinal format, the printing of narrower recording media in duplex mode, i.e. with front side and back side printing, multi-color, single-sided printing, and the printing of a plurality of recording media in parallel mode.

The apparatus dimension, the manufacturing costs as well as the operational reliability and dependability correspond to those of known printer machines despite the critical expansion of functions, a need for a flexibly employable electrographic printer means that has existed for many years being thus satisfied.

BRIEF DESCRIPTION OF THE DRAWINGS

Embodiments of the invention are shown in the drawings and are described in greater detail below by way of example. Shown are.

DETAILED DESCRIPTION OF THE PREFERRED EMBODIMENTS

Figure 1:
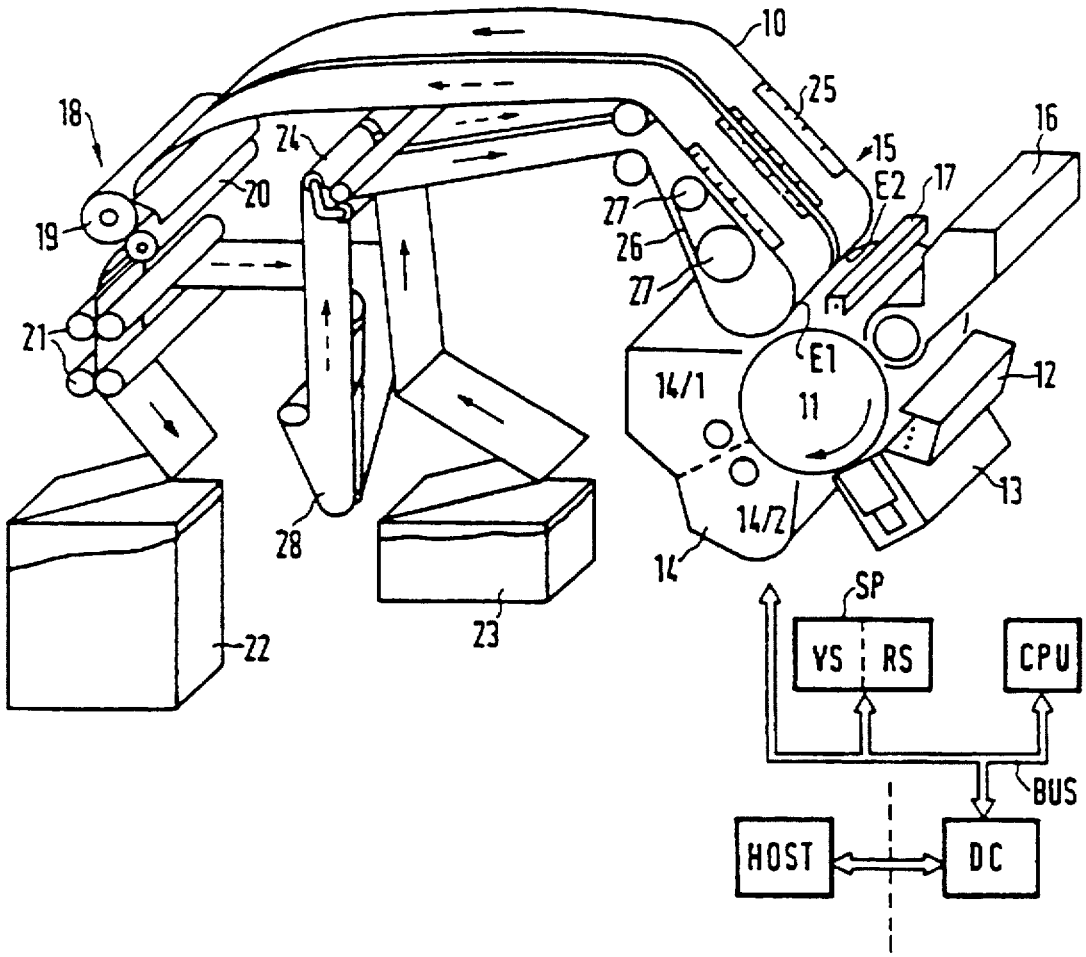
FIG. 1 a schematic illustration of an electrographic printer device for printing tape-shaped recording media in duplex mode.

An electrographic printer device for printing tape-shaped recording media 10 differing in tape width contains an electromotively driven photoconductive drum as intermediate carrier 11. However, a tape-shaped intermediate carrier, for example and OPC tape or a magneto-styli arrangement as disclosed, for example, by EP-B1-0 191 521, can also be employed instead of the photoconductive drum. The various units for the electrophotographic process are grouped around the intermediate carrier 11. These are, essentially: a charging means 12 in the form of a charging corotron for charging the intermediate carrier 11; a character generator 13 with a light-emitting diode comb for character-dependent exposure of the intermediate carrier 11 that extends over the entire usable width of the intermediate carrier 11; a developer station 14 for inking the character-dependent charge image on the intermediate carrier 11 with the assistance of a one-component or two-component developer mix; a transfer printing station 15 that extends over the width of the intermediate carrier 11 and with which the toner images are transferred onto the recording medium 10. A cleaning station 16 with cleaning brushes integrated therein with appertaining extraction means as well as a discharge means 17 is provided for removing the residual toner after the development and after the transfer printing. The intermediate carrier 11 is electromotively driven and moves in arrow direction during print mode.

The printer device further contains a fixing station 18 following downstream from the transfer printing station 15 in conveying direction of the recording medium, this fixing station 18 being fashioned as thermal pressure fixing station with a heated fixing drum 19 having appertaining pressure roller 20, as well as guide rollers 21 following the fixing station that serve, among other things, as output elements for a stacker means 22 for the recording medium 10. Instead of the illustrated fixing station, other fixing stations, for example with a heated or unheated admission saddle, or a cold fixing station are also possible. The tape-shaped recording medium 10, for example, is fabricated as pre-folded continuous stock provided with margin perforations and is supplied to the transfer printing station via delivery rollers 24 proceeding from a supply region 23. However, it is also possible to supply a recording medium without margin perforations via a roller delivery.

The conveying of the recording medium thereby preferably ensues via a conveyor means 25 allocated to the transfer printing station 15 and having the form of conveyor belts provided with pins that, conducted over drive shafts 27, engage into the margin perforations of the recording medium 10. When a recording medium free of conveying holes is employed, it is at the command of a person skilled in the art to convey the recording medium with, for example, friction, controlled by a control arrangement that senses synchronization marks. Further, a deflection means 28, whose function shall be explained later and via which the recording medium is returned from the fixing station 18 to the transfer printing station, is arranged in the housing region of the printer device between supply region 23 and the fixing station 8.

The printer device is controlled via a printer controller, schematically shown here, comprising a central unit CPU, a page memory SP that is divided into memory areas page-dependent, as well as comprising a data control unit DC. All units of the controller are connected to one another and to the units of the printer device via a bus system.

The electrographic printer device is suitable for printing recording media with different tape widths. To this end, the intermediate carrier 11 (photoconductive drum) comprises a usable width that corresponds to the greatest possible recording medium width (for example, a DIN A3 format broadside). This width corresponds to twice the DIN A4 tape width. It is thus possible to arrange two DIN A4 recording medium widths longitudinally side-by-side in the region of the transfer printing station. The fixing station 18 and the other electrophotographic units such as developer station 14, character generator 13, cleaning station 16 are designed in conformity with this usable width.

A matching of the width of the character generator 13 to different recording medium widths requires no mechanical modification at the character generator when, as in this case, an LED character generator comprising a plurality of LEDs arranged in rows is employed. A matching to the width of the recording medium employed ensues by electronic selection.

The conveyor means can be fashioned width-adjustable for matching the conveyor means 25 to different recording medium widths. This can be achieved, for example, in that the drive wheels that carry the conveyor belts (nubbed belts) that engage into the margin perforations of the recording medium are displaceably seated on polygonal shafts.

When two narrow recording media are arranged side-by-side and conveyed in the region of the transfer printing station 15, it normally suffices to provide a conveyor means only for the margin perforations lying respectively at the outside. Given a corresponding design, it is therefore possible to employ the same conveyor belts for the wide recording medium and the two narrower recording media without having to adjust these conveyor belts. If it nonetheless becomes necessary to guide the recording media at both sides, then centrally separated conveyor elements that engage into the margin perforations of the recording media can be provided for operation with two narrow recording media arranged side-by-side. So that these conveyor elements to not get in the way given operation with only one wide recording medium, they can be arranged pluggable and unpluggable or so as to be pivoted out or, on the other hand, it is possible to provide the drive wheels 27 of the conveyor means 25 with retractable and extensible pins or, respectively, nubs.

The deflection means 28 arranged in a return channel for narrow recording media from the fixing station to the transfer printing station has two jobs: In throughout mode (FIG. 6), it serves for lateral displacement of the recording medium web and, in turn-over mode (FIG. 7), it serves for turning the recording medium from front side to back side. It is fashioned switchable dependent on operating mode. Three deflection elements 29/1,29/2 and 29/3 fashioned as drums or deflection rods with a smooth, wear-resistent surface serve for the vertical excursion of the recording medium. Given a corresponding arrangement of the deflection means in the printer device according to the exemplary embodiments of FIGS. 1 through 3, the function of the deflection element 29/2 can be performed by the delivery rollers 24. Further, the deflection means contains a deflection contour composed of two rods 30/1 and 30/2 that are arranged inclined by 45° relative to the conveying direction of the recording medium in the illustrated exemplary embodiment. The second deflection rods 30/2 as viewed in conveying direction of the recording medium is arranged pivotable via a mechanism that is not shown here, namely from a position parallel to the first deflection rod 30/1 into a position perpendicular thereto. The deflection rods 30/1 and 30/2 dare not be fashioned as rotating drums since the recording medium would drift laterally in the rolling motion. They are fashioned as stationary drum or as a corresponding formed part. Since the recording medium, which is usually composed of paper, slides across the surface, it is advantageous to select a smooth and wear-resistent coating and/or to blow air through opening, which can lie in the contact surface, and to thereby build up an air pillow. The horizontal deflection elements 29/1 through 29/3 can be fashioned as rotatable drums or as stationary deflection rods corresponding to the deflection contour, potentially with air discharge openings.

Figure 6:
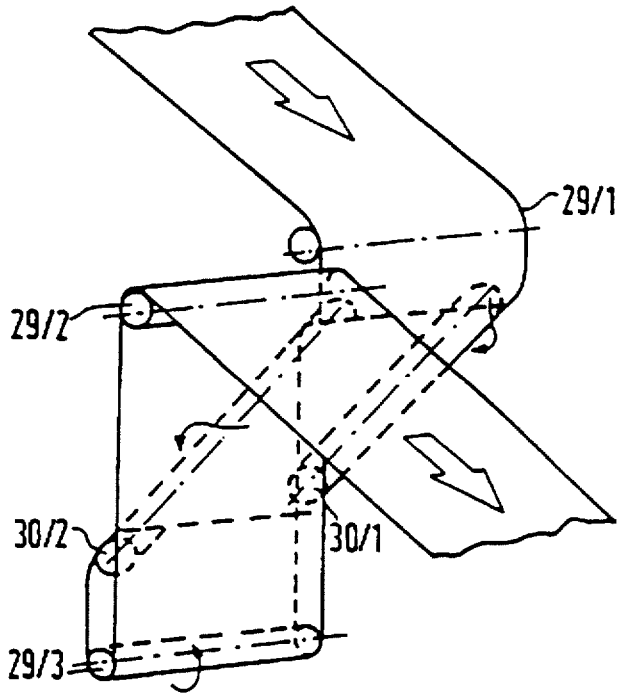
FIG. 6 a schematic illustration of a deflection means arranged in the electrographic printer device in throughput mode (simplex printing)

In the throughput mode shown in FIG. 6, the recording medium returned from the fixing station is first deflected downward via the deflection drum 29/1 and is then conducted around the deflection rod 30/1 according to the arrow direction and is thus horizontally deflected. This is followed by a renewed downward deflection around the deflection rod 30/2 in vertical direction. After another deflection by the horizontal deflection drum 29/3, a delivery of the width-offset recording medium ensues to the deflection element 29/2 or, respectively, the delivery rollers 24.

Figure 7:
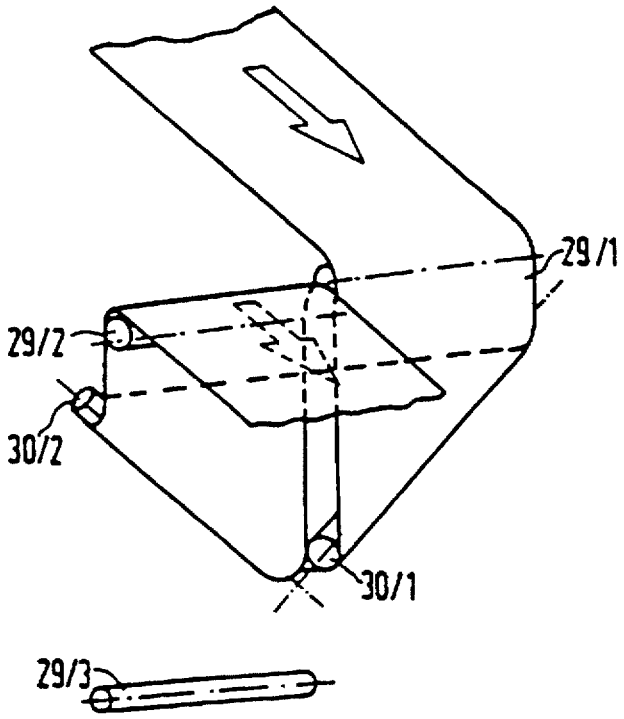
FIG. 7 a schematic illustration of the same deflection means in turn-over mode (duplex printing)

In the turn-over position of the deflection means shown in FIG. 7, the recording medium is turned over by 180° in the illustrated way. The recording medium is thereby first deflected downward via the horizontal deflection roller 29/1, is conducted from from to back around the first oblique deflection rod 30/1 and is thus horizontally deflected. A renewed deflection around the second oblique deflection rod 30/2 subsequently ensues with delivery to the horizontal deflection element 29/2 or, respectively, to the delivery rollers 24 following thereupon.

Function of the electrographic printer device in different operating modes

Simplex mode

Figure 4:
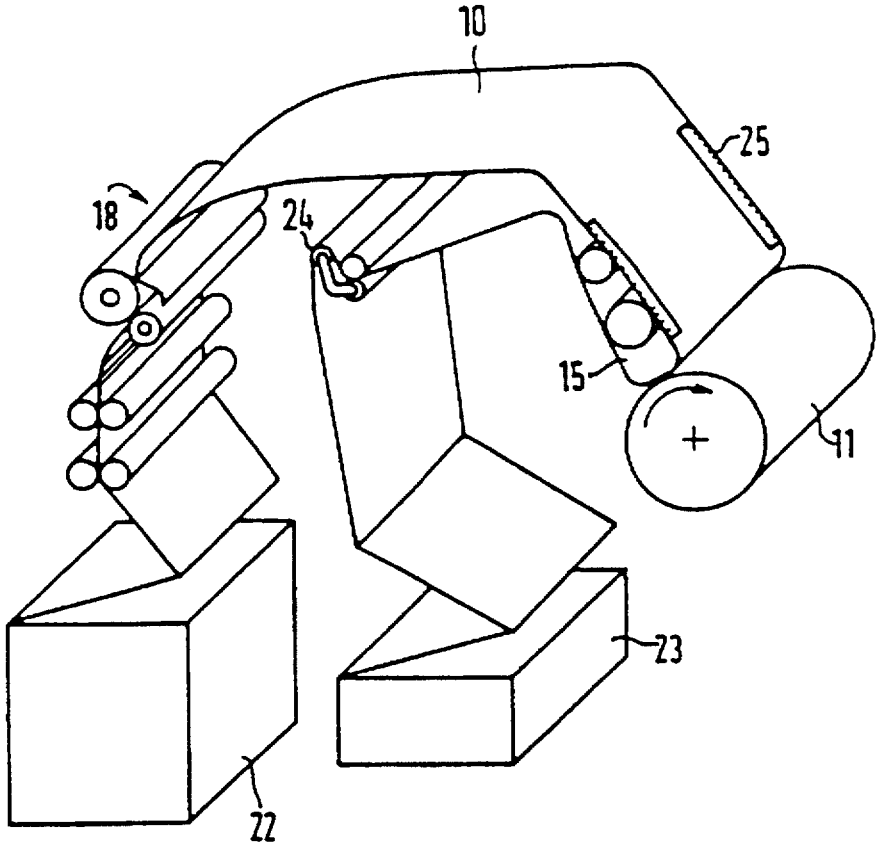
FIG. 4 a schematic illustration of the same electrographic printer device in simplex mode for printing a broad, tape-shaped recording medium.

The inventive printer device enables the greatest variety of operating modes without modifying the hardware structure. For single-sided printing of a wide recording medium corresponding to the illustration of FIG. 4, the recording medium, proceeding from the supply region 23 (supply stack), is conducted in a conventional way via the delivery rollers 24 to the transfer printing station 15, is provided with toner images thereat and fixed in the fixing station 18 and is subsequently deposited in the stacker means 22. The conveying thereby ensues via the conveyor means 25 that engages into the margin perforations of the recording medium, whereby the width of the conveyor means 25 is set corresponding to the width of the recording medium.

Such a wide recording medium enables, for example, printing with toner images arranged DIN A3 broadside or, on the other hand, with two tone images DIN A4 arranged side-by-side.

Figure 5:
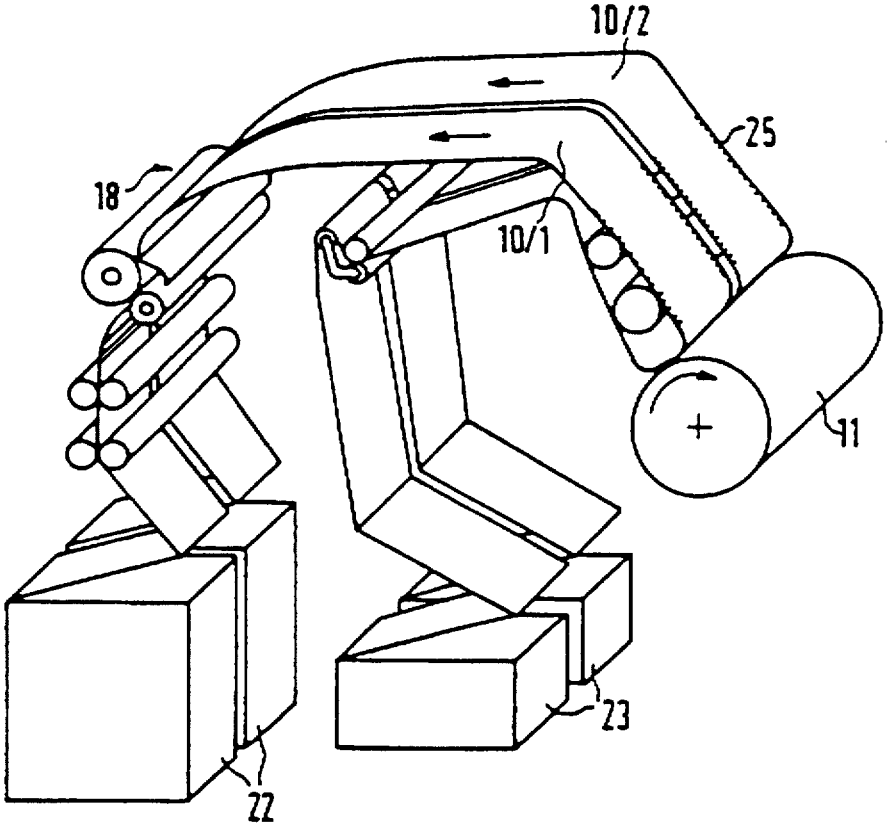
FIG. 5 a schematic illustration of the same electrographic printer device in simplex mode for the simultaneous printing of two tape-shaped recording media.

For printing two narrow recording media arranged side-by-side, for example with a width DIN A4, the two recording medium webs 10/1,10/2 are conducted parallel through the printer device corresponding to the illustration of FIG. 5. The conveying of the recording medium webs 10/1 and 10/2 ensues via the correspondingly set conveyor means 25. In the illustrated exemplary embodiment, the recording medium webs 10/1 and 10/2 are conveyed at both sides via their margin perforations. As already set forth, the middle conveyor elements can be brought into engagement for this purpose with the inner margin perforations of the recording medium webs 10/1 and 10/2 by extending corresponding pins. It is also possible to fashion these inner conveyor elements as elements that can be put in place as needed. For conveying the recording medium webs 10/1 and 10/2 in the region of the transfer printing station, it is also fundamentally possible to employ only the outer conveyor elements and to thus convey the recording medium webs at one side.

Single-Color Duplex Mode

For both-sided, single-color printing of a narrow recording medium in duplex mode as shown in FIG. 1, the narrow, for example DIN A4 wide recording medium is supplied to the transfer printing station 15 via the delivery rollers 24 proceeding from the supply region 23 and is printed with a front side toner image at its top side. The front side of the recording medium 10 is thereby characterized by solid-line conveying arrows, the bottom side by broken-line conveying arrows. Subsequently, the recording medium with the front side toner image is supplied to the fixing station 18 and the front side toner image is fixed. A further-conveying of the recording medium via the guide rollers 21 ensues to the deflection means 28 whose deflection contour is positioned in a turn-over position. The recording medium is turned with respect to it s front side and back side in the deflection means 28 and is resupplied via the delivery rollers 24 to the transfer printing station 15, so that its back side can be provided with a back side toner image. Subsequently, the recording medium is resupplied to the fixing station 18 and the back side toner image is fixed, and, subsequently, the recording medium printed on both sides is deposited in the stacker means 22.

Since the front side and back side toner images are generated at different points in time and are transferred onto the recording medium, a corresponding data editing via the printer controller is necessary. To this end, the page memory SP contains memory areas VS for storing the front side image data and memory areas RS for storing the back side image data. The data editing thereby ensues via the data control means DC, whereby the data are supplied via an interface to the data control means DC proceeding from a data source (HOST), for example an external data store. The data of the individual pages to be printed are thereby deposited in the page memory SP, namely in the corresponding memory areas separated according to front side VS and back side RS> The fetching of the data then ensues time-controlled, so that the desired front side/back side allocation of the toner images on the recording medium is achieved.

Two-Color Duplex Mode

The printer device is also suitable for multi-color printing mode. To this end, the developer station 14 can be fashioned such according to the illustration of FIG. 2 that it generates developer zones El and E2 on the intermediate carrier 11 that can be separately inked. A corresponding developer zone El or, respectively, E2 on the intermediate carrier 11 is thereby allocated to each position region of the narrow recording medium when passing through the transfer printing station 15. Respectively two developer stations 14/1 and 14/2 arranged following one another can be allocated to the developer zones for generating these separately inkable developer zones El and E2. The developer station 14/1 thereby contains a toner mix of a first color, for example red, and the developer station 14/2 contains a developer |sic| mix in a second color, for example black. The developer stations 14/1 and 14/2 are fashioned to be separately activatable in view of the developer zones El and E2, namely either by mechanical flaps or the like or by an electrical drive of the developer drums. Each of the developer stations 14/1 and 14/2 can extend over the entire width of the intermediate carrier 11; however, it must be assured that they can be individually separately driven in view of the developer zones El and E2. However, it is also possible to fashion each of the developer stations 14/1 and 14/2 as two developer stations arranged separately next to one another.

Figure 2:
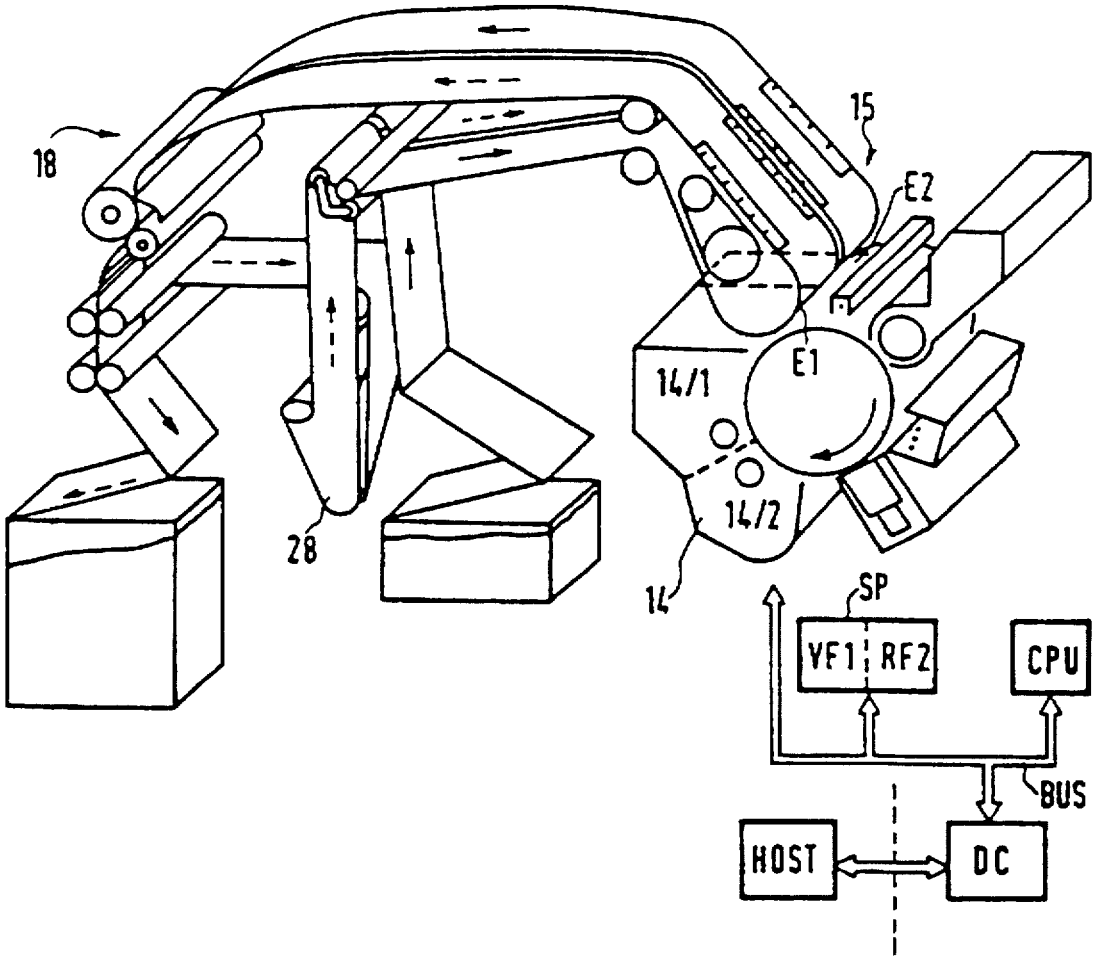
FIG. 2 a schematic illustration of the same electrographic printer device in two-color duplex mode.
Figure 3:
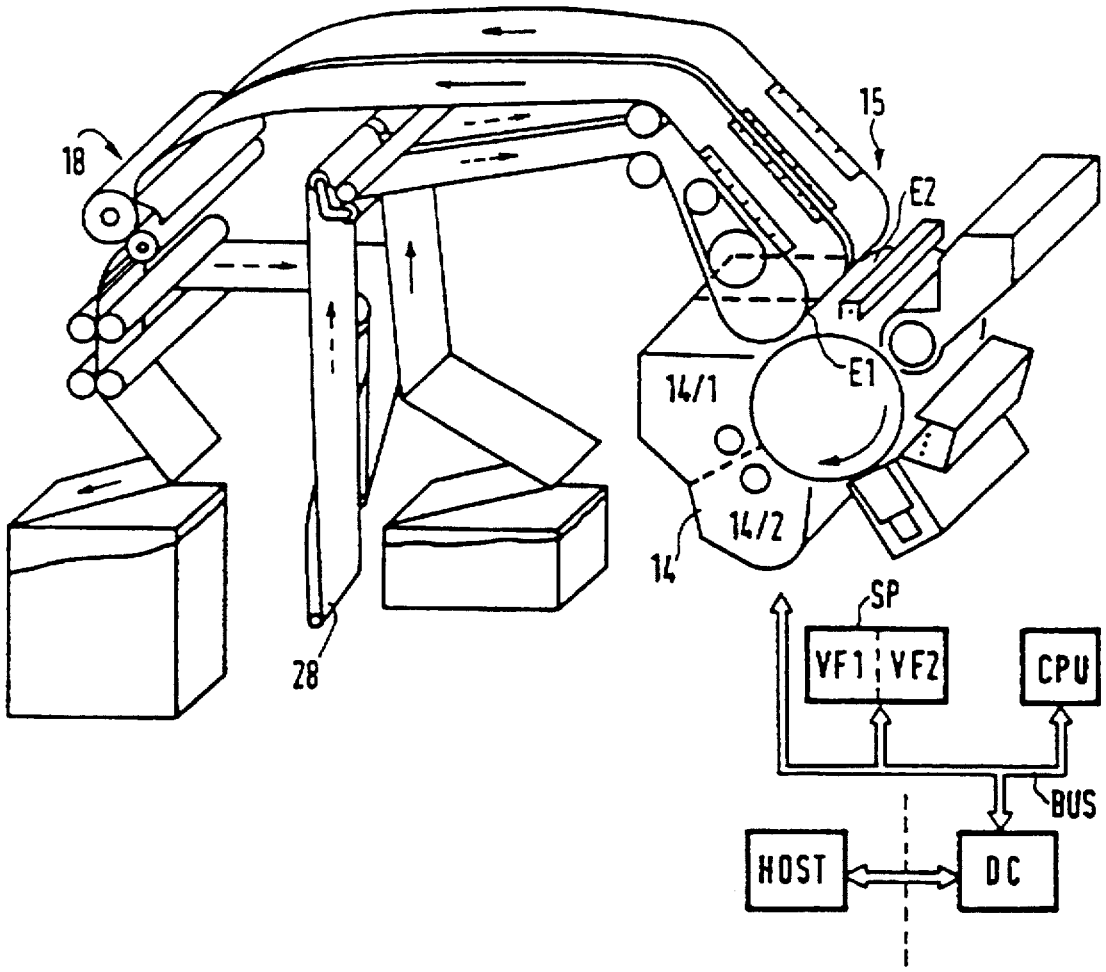
FIG. 3 a schematic illustration of the same electrographic printer device in two-color simplex mode.

In order, according to the illustration of FIG. 2, to be able to print a narrow recording medium with different colors on both sides, the recording medium is conducted through the printer device in the same way as in FIG. 1. The application of a front side image in a first color, for example red, thereby ensues via the developer station 14/1 in the developer zone E2 in a first pass through the transfer printing station 15. After the turn-over event via the deflection means 28, a back side toner image in a second color, for example black, is applied via the developer station 14/2 in the developer zone El in a second pass through the transfer printing station 15. The control of the application of the toner images in the exemplary embodiment of FIG. 1 ensues via the printer controller, whereby the image data for the front side toner image in color 1 (red) are deposited in the memory area VF1 of the page memory and the image data for the back side toner image in color 2 (black) are deposited in the memory area RF2.

It should be noted that the separate developer stations 14/1,14/2 can also be employed for the both-sided, single-color printing of the recording medium in duplex mode according to FIG. 1. In this case, only one of the developer stations 14/1 or 14/2 is simply activated dependent on the desired color.

Device Structure

Figure 8:
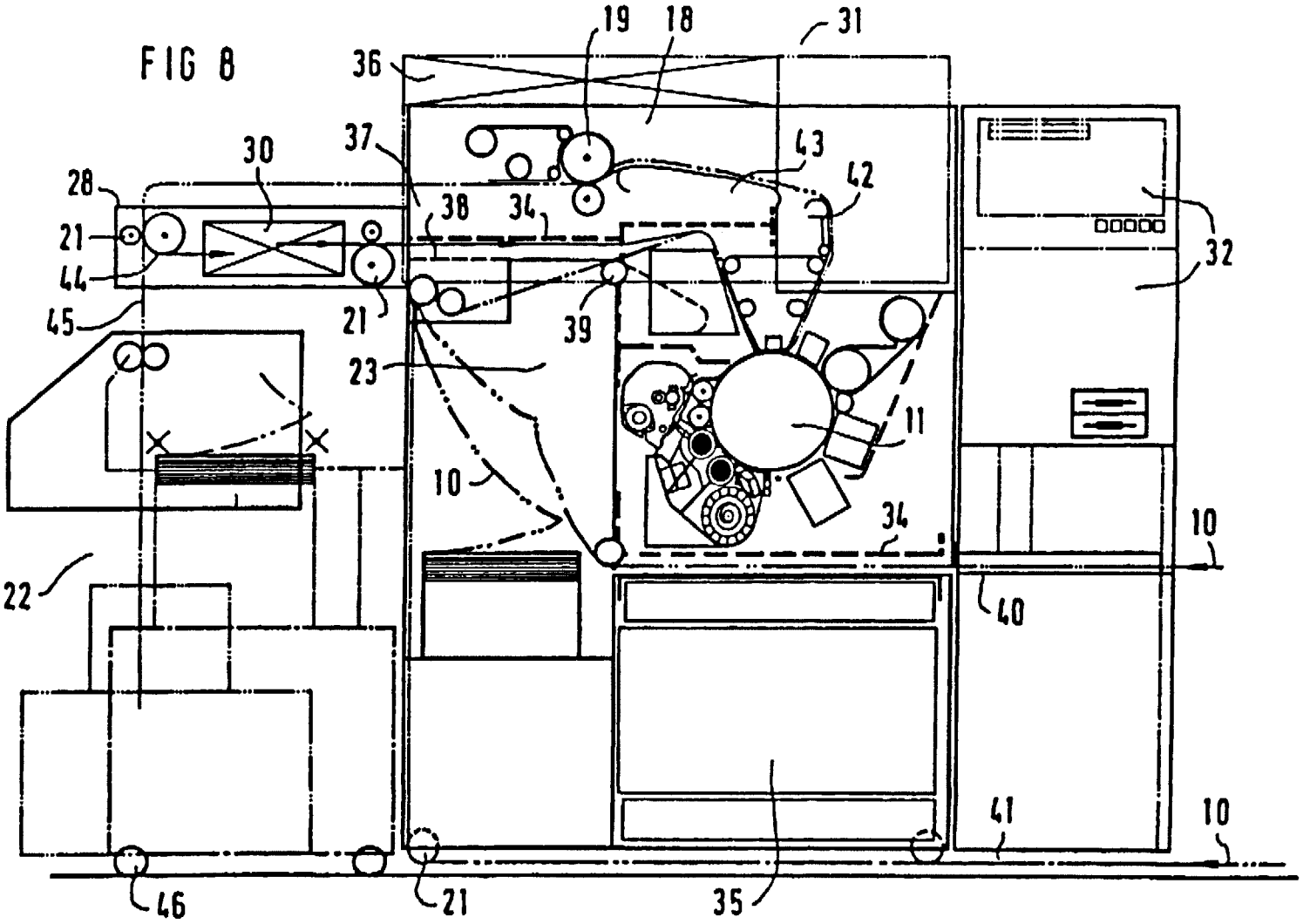
FIG. 8 a schematic illustration of the device structure of the electrographic printer device, partially in section.
Figure 9:
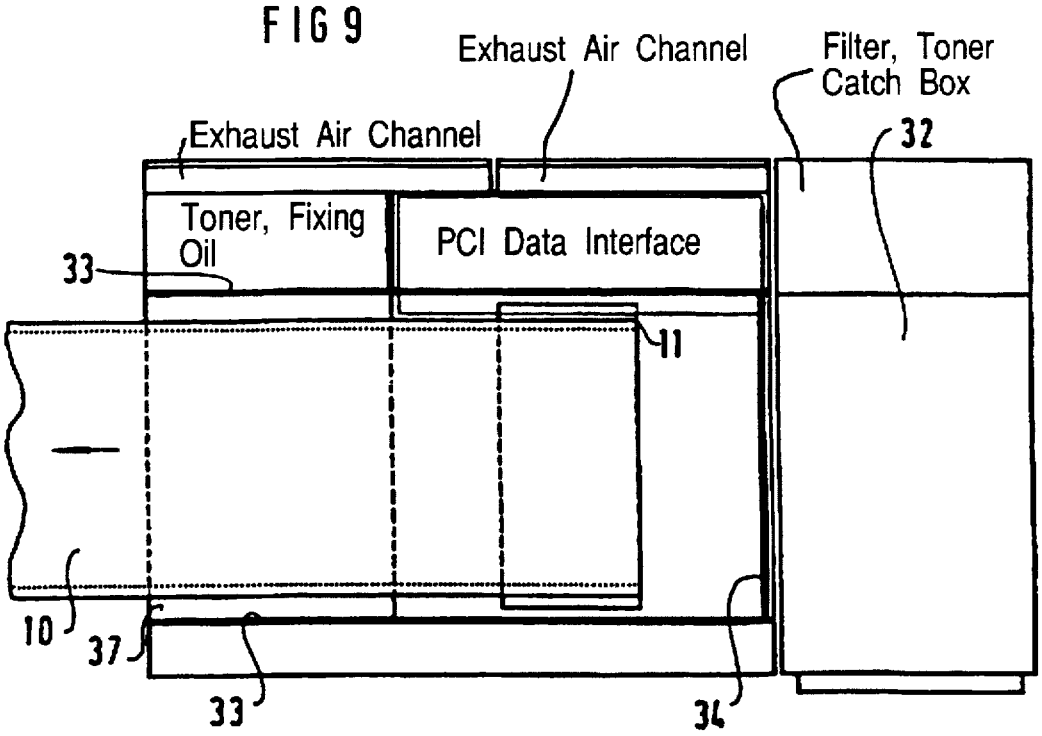
FIG. 9 a schematic illustration of the device structure of the electrographic printer device from above.

As shown in FIGS. 8 and 9, the multi-functional printer device is composed of a central printer module 31 with deflection means 28 adapted thereto and an accompanying, mobile stacker means 22, as well as of a control module 32 with operating surface. The printer module 31 is constructed as a distortion-stable torsion box. To this end, two lateral sheet steel billets 33 extending to the floor are connected to one another via intervening traverse elements 34 in the form of extruded aluminum profiles to form a torsionally rigid supporting framework. This serves, among other things, for the acceptance of the core electrophotographic units, namely the means with intermediate carrier (photoconductive drum) 11 generating the toner images, charging means 12, character generator 13, developer station 14, transfer printing station 15, cleaning station 16, discharge means 17 and fixing station 18. The individual units are thereby suspended in the lateral billets 33, as a result whereof a high-precision allocation of the units to one another is achieved. The risk of paper running faults due to misalignment is thereby reduced during operation of the printer device. Repeated readjustment is thus eliminated. The allocation stability is further enhanced in that stable unit sub-modules are formed via the cross-bracings 34 allocated to the individual units. For example, in the form of a fixer module 18, a photoconductor module, a region for the supply stack 23 and a region for the acceptance of the device electronics 35.

For forming a service-friendly, compact printer structure, the individual units are arranged such within the printer module that, on the one hand, the throughput path of the paper web 10 becomes optimally short and, on the other hand,the heat required for the fixing process does not negatively influence the units or, respectively, the paper web. To this end, the fixing station 18 is arranged in the uppermost region of the printer module above the means (intermediate carrier 11) that generates the toner images. The heat arising during fixing, including the substances exhaled [sic] by the paper, are immediately extracted via a vapor extraction hood 35. The paper web traverses the fixing station 18 nearly horizontally and leaves the printer module via a paper output channel 37. A return channel 38 that likewise proceeds horizontally is located under the fixing station for returning the narrow recording medium that has been deflected and/or turned over via the deflection means 38. In a feed region to the photoconductor module (means that generates toner images), the return channel 38 is in communication with a delivery channel 39 for recording media of different tape widths. The recording medium 10,10/1,10/2 is supplied to the photoconductor module via this delivery channel 39 proceeding from a supply region, for example the supply stack 23. Further, external delivery channels 40,41 that 40 cut through the printer module or lead 41 around the printer module are also provided in order to be able to supply the recording medium to the photoconductor module proceeding from an external supply stack. The entire paper path through return channel 38, photoconductor module and fixing station 18 is designed such that an optimally short paper running distance derives and such that the recording medium is supplied approximately horizontally to the deflection means 28 and passes therethrough roughly horizontally. The following cooling path thus becomes arbitrarily large and can be freely designed. A complicated production of cooling air is thus eliminated.

Conveyed by the conveyor means 25, the paper web leaves the transfer printing station 15 steeply upward, is deflected by 60–90° via a looper 42 and by up to 45° more via a saddle 43, and passes through the fixing drums 19,20 nearly horizontally. Since the minimum wrap angles of looper 42 and saddle 43 are functionally predetermined, it is beneficial for achieving such a horizontal feed attitude when the transfer printing station 15 is arranged roughly in the middle above the photoconductive drum 11.

The deflection means 28 is likewise fashioned as a module that can be coupled to the paper output channel 37 and the return channel 38 of the printer module via releasable fastening means, for example screw-type or snap-in closures. It contains guide rollers 21 and, as a separate structural unit, a turn-over means 30 fashioned according to FIGS. 6 and 7. This turn-over means 30 can likewise be detachably secured on carriers of the deflection means and, for example, can be pulled out via hinges. It is freely accessible, so that disturbances in paper running can be eliminated without parting the paper web.

The deflection means 28 also contains a manually or motor actuatable shunt 44 via which the recording medium 10, proceeding from the paper output channel, is supplied via the deflection means to the return channel 38 in a first operating mode of the printer device for multiple printing of the narrow recording medium 10, and, after another pass through the means that generates toner images, is supplied to the mobile stacker means 22 via an output channel 45 allocated to the deflection means. The mobile stacker means 22 provided with rollers 46 and/or the sidewall of the printer module can comprise fit elements that enable a positionally exact seating of the stacker means 22 against the printer module. The deflection means 28 can likewise be part of the stacker means 22.

Although other modifications and changes may be suggested by those skilled in the art, it is the intention of the inventors to embody within the patent warranted hereon all changes and modifications as reasonably and properly come within the scope of their contribution to the art.

We claim:

1. Multi-functional printer device for printing tape-shaped recording media with different tape widths, comprising a means that generates toner images that comprises a usable width of at least twice the tape width of a narrow recording medium;

a single fixing station arranged above said means and having an essentially horizontal passage of the recording medium webs, whereby the fixing station spans the recording medium webs;

a paper output channel via which the recording medium leaves the fixing station;

a return channel proceeding under the fixing station that accepts the narrow recording medium, that is in communication with a delivery channel for recording media of different tape widths in a delivery region to the means that generates toner images and that comprises a turn-over means;

a deflection means that can be arranged between the paper output channel and the input of the return channel and that has an allocated output channel for the recording media, whereby in a first operating mode of the printer device for multiple printing of the single, narrow recording medium, the recording medium —proceeding from a supply region—is conducted via the means for generating toner images to a use region of the fixing station and, from the latter, is conducted via the deflection means and the return channel back again to the means for generating toner images and a use region of the same fixing station neighboring said use region, and in a second operating mode of the printer device for single-sided printing of one or more recording media of different tape widths, the recording medium or media—proceeding from the supply region—are conducted only via the means for generating toner images to the single fixing station.

2. Multi-functional printer device according to claim 1, whereby the turn-over means is fashioned such that the narrow recording medium is supplied to the means for generating toner images turned with respect to front/back side compared to its original feed attitude.

3. Multi-functional printer device according to claim 1, whereby the turn-over means is fashioned such that, in a first operating position, the turn-over means supplies the narrow recording medium to the return channel turned with respect to front/back side compared to its original feed attitude, and such that, in a second operating position, the turn-over means supplies the narrow recording medium to the return channel in its original feed attitude.

4. Multi-functional printer device according to claim 1, whereby the function units of the multi-functional printer device are at least partly fashioned as modules.

5. Multi-functional printer device according to claim 1, whereby the turn-over means is arranged essentially horizontally in extension of the return channel.

6. Multi-functional printer device according to claim 1, whereby the printer device comprises coupling elements for connecting the deflection means and/or a stacker means.

7. Multi-functional printer device according to claim 1, whereby the printer device is constructed at least partially as a distortion and torsion-stable box comprising side billets connected by traverse elements and between which the functions units are arranged.

8. Multi-functional printer device according to claim 7 comprising traverse elements fashioned as extruded profiles.

9. Multi-functional printer device according to claim 1, comprising a mobile stacker means that can be coupled to the printer device.

10. Multi-functional printer device according to claim 9, comprising a receptacle region for the stacker means that is limited by the deflection means and a housing wall of the printer device, whereby the output channel of the deflection means lies opposite an input channel of the stacker means in the coupled condition of the mobile stacker means.

11. Multi-functional printer device according to claim 1, whereby the turn-over means is arranged freely accessible in the printer device for eliminating paper running disturbances.

12. Multi-functional printer device according to claim 1, comprising a thermal fixing station as fixing station.

13. Multi-functional printer device according to claim 1, comprising a cold fixing station as fixing station.

14. Multi-functional printer device according to claim 1, comprising a conveyor means that conveys the recording media in the region of a transfer printing station of the means for generating toner images and that is fashioned adjustable dependent on the operating mode, particularly tape width and plurality of the recording medium webs conducted in the region of the transfer printing station.

15. Multi-functional printer device according to claim 1, comprising one or more developer stations that generate developer zones on an intermediate carrier that can be separately inked, whereby a corresponding developer zone is allocated to at least every position region of the narrow recording medium when passing through the transfer printing station.

* * * * *